US005761927A

United States Patent [19]

Agrawal et al.

[11] Patent Number: 5,761,927

[45] Date of Patent: Jun. 9, 1998

[54] PROCESS TO PRODUCE NITROGEN USING A DOUBLE COLUMN AND THREE REBOILER/CONDENSERS

[75] Inventors: Rakesh Agrawal, Emmaus; Catherine Catino Latshaw, Fogelsville, both of Pa.

[73] Assignee: Air Products and Chemicals, Inc., Allentown, Pa.

[21] Appl. No.: 841,134

[22] Filed: Apr. 29, 1997

[51] Int. Cl.[6] ..... F25J 3/04

[52] U.S. Cl. ..... 62/643

[58] Field of Search ..... 62/640, 643, 646, 62/900, 903, 905

[56] References Cited

U.S. PATENT DOCUMENTS 4,453,957 6/1984 Pahade et al. .
4,617,036 10/1986 Suchdeo et al. .
4,715,873 12/1987 Auvil et al. ..... 62/646
5,006,139 4/1991 Agrawal et al. ..... 62/646
5,069,699 12/1991 Agrawal ..... 62/646
5,123,947 6/1992 Agrawal ..... 62/643
5,257,504 11/1993 Agrawal et al. ..... 62/646
5,392,609 2/1995 Girault et al. ..... 62/646
5,404,725 4/1995 Arriulou ..... 62/646
5,440,885 8/1995 Arriulou ..... 62/646
5,644,933 7/1997 Rathbone ..... 62/646
5,682,764 11/1997 Agrawal et al. ..... 62/900 X

*Primary Examiner*—Christopher Kilner
*Attorney, Agent, or Firm*—Robet J. Wolff

[57] ABSTRACT

A process is set forth for the cryogenic distillation of an air feed to produce nitrogen, particularly high pressure nitrogen of ultra high purity (less than 100 parts per billion of oxygen). A key to the present invention is that, in addition to the conventional reboiler/condenser which links the high and low pressure column, the present invention utilizes two additional reboiler/condensers such that the oxygen rich liquid which collects at the bottom of the low pressure column is reboiled at three different pressure levels.

5 Claims, 2 Drawing Sheets

PROCESS TO PRODUCE NITROGEN USING A DOUBLE COLUMN AND THREE REBOILER/CONDENSERS

BACKGROUND OF THE INVENTION

The present invention relates to a process for the cryogenic distillation of an air feed. As used herein, the term "air feed" generally means atmospheric air but also includes any gas mixture containing at least oxygen and nitrogen.

The target market of the present invention is high pressure nitrogen of high purity (less than 10 parts per million of oxygen) to ultra high purity (less than 100 parts per billion of oxygen and more preferably less than 10 parts per billion of oxygen) such as the nitrogen which is used in various branches of the chemical and electronic industry. It is an objective of the present invention to design an efficient double column air separation cycle to meet this need.

Double column air separation cycles to produce high pressure nitrogen of ultra high purity are taught in the art. See for example U.S. Pat. Nos. 4,617,036 and 4,453,957 which are representative of the closest art to the present invention. In the double column air separation cycle taught in U.S. Pat. No. 4,617,036, vapor air is fed to the bottom of the high pressure column. High pressure nitrogen gas product is recovered from the top of this column, while an oxygen-enriched liquid bottoms and an impure liquid nitrogen side stream are reduced in pressure an introduced as reflux to the low pressure column. Lower pressure nitrogen product is taken off the top of the low pressure column. Staged reboiling at two different pressures is used to increase cycle efficiency. The oxygen-enriched liquid bottoms is partially vaporized in the reboiler/condenser located in the bottom of the low pressure column, providing the boil-up for this column. A portion of the oxygen-enriched liquid bottoms from the low pressure column is reduced in pressure and vaporized in the lower pressure reboiler/condenser. The oxygen-enriched vapor from this side reboiler is warmed and expanded to provide refrigeration for the process before exiting he system as waste. Both reboiler/condensers condense a portion of the nitrogen vapor from the top of the high pressure column, providing the necessary liquid reflux to the high pressure column.

The double column cycle taught in U.S. Pat. No. 4,453,957 also produces nitrogen at two different pressures. Vapor air is again fed to the bottom of the high pressure column while a high pressure gaseous nitrogen product is taken off the top and an oxygen-enriched liquid bottoms stream is sent to the low pressure column. Lower pressure nitrogen product is taken off the top of the low pressure column, while the oxygen-enriched liquid bottoms from the low-pressure column is sent to the top of this column to condense some of the gaseous nitrogen, providing reflux to this column. The oxygen-enriched vapor produced in this heat exchange is removed from the process as waste. In one embodiment of this invention, this oxygen-enriched vapor waste stream is warmed and expanded to provide the necessary refrigeration, while in another embodiment a portion of the feed air stream is expanded into the lower pressure column to generate refrigeration.

In these processes, any nitrogen that is produced from the low pressure column must be further compressed for use in the electronics applications. This further compression is quite costly, and often unacceptable due to the ultra high purities involved. Flow through the compression machinery could contaminate the pure product. In addition, recovery of high pressure nitrogen is limited and cannot be increased in U.S. Pat. No. 4,617,036 nor in the air expander embodiment of U.S. Pat. No. 4,453,957.

BRIEF SUMMARY OF THE INVENTION

The present invention is a process for the cryogenic distillation of an air feed to produce nitrogen, particularly high pressure nitrogen of ultra high purity (less than 100 parts per billion of oxygen). A key to the present invention is that, in addition to the conventional reboiler/condenser which links the high and low pressure column, the present invention utilizes two additional reboiler/condensers such that the oxygen rich liquid which collects at the bottom of the low pressure column is reboiled at three different pressure levels.

DETAILED DESCRIPTION OF THE INVENTION

The present invention is a process for the cryogenic distillation of an an air feed to produce nitrogen. The process uses a distillation column system comprising high pressure column, a low pressure column and three reboiler/condensers.

Figure 1:
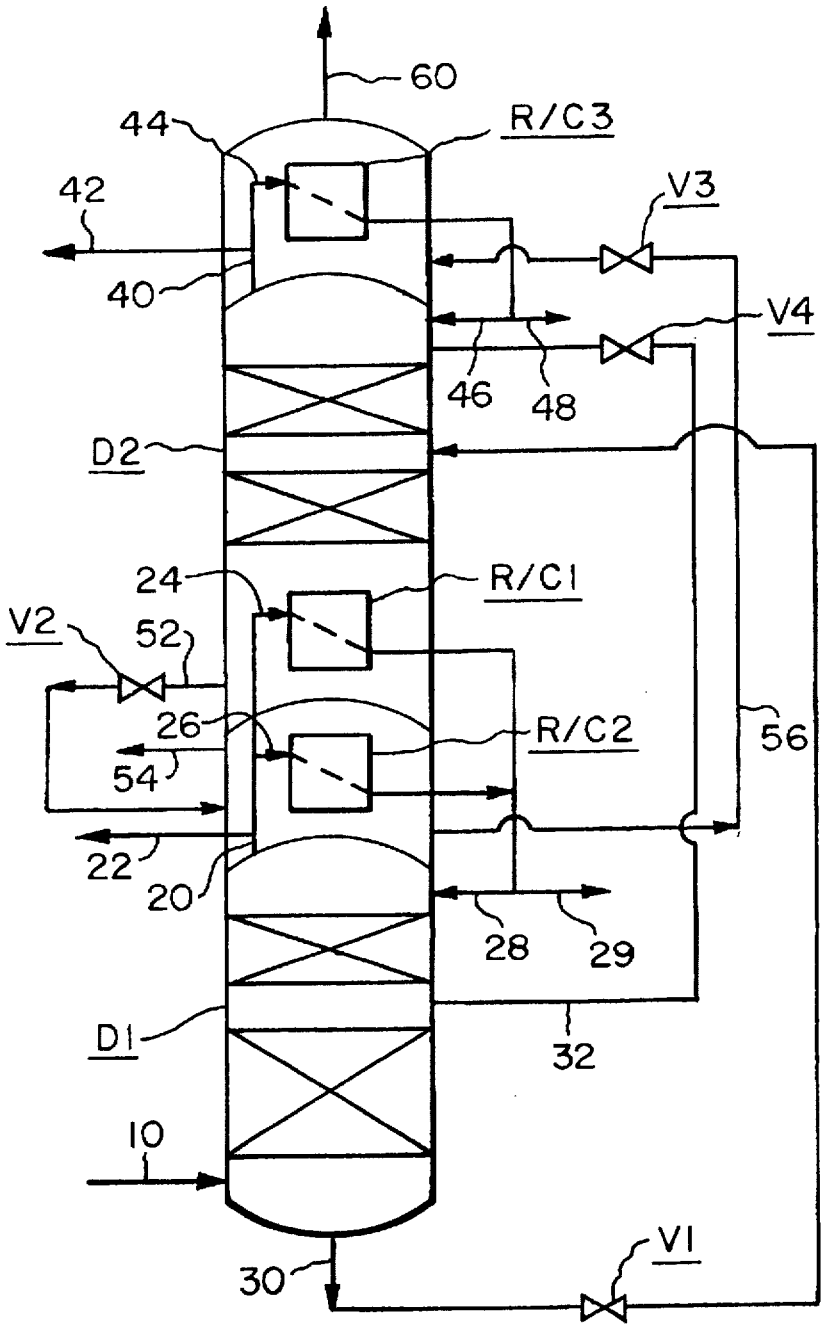
FIG. 1 is a schematic drawing of one general embodiment of the present invention.

In its broadest embodiment, and with reference to FIG. 1, the process of the present invention comprises:

(a) feeding at least a first portion of the air feed [10] to the bottom of the high pressure column [D1];

(b) collecting a nitrogen-enriched overhead [20] at the top of the high pressure column, removing a first portion [22] as a high pressure gaseous nitrogen product, condensing a second portion [24] in a first reboiler/condenser [R/C 1]located in the bottom of the low pressure column [D2], condensing a third portion [26] in a second reboiler/condenser [RIC 2] and feeding at least a first part [28] of the condensed second and/or third portions as reflux to an upper location in the high pressure column;

(c) removing a crude liquid oxygen stream [30] from the bottom of the high pressure column, reducing the pressure of at least a first portion of it [across valve V1] and feeding said first portion to the low pressure column;

(d) collecting a nitrogen rich overhead [40] at the top of the low pressure column, removing a first portion [42] as a low pressure nitrogen product, condensing a second portion [44] in a third reboiler/condenser [R/C 3] and feeding at least a first part [46] of the condensed second portion as reflux to an upper location in the low pressure column; and (e) collecting an oxygen rich liquid at the bottom of the low pressure column, vaporizing a first portion in the first reboiler/condenser located in the bottom of the low pressure column [to provide boil-up at the bottom of the low pressure column], reducing the pressure of a second portion [52] [across valve V2], partially vaporizing aid second portion in said second reboiler/condenser, removing the resulting vaporized portion [54] as a first waste stream, further reducing the pressure of the remaining liquid portion [56] [across valve V3], vaporizing the liquid portion in the third reboiler/condenser and removing the vaporized stream [60] as a second waste stream.

In one particular embodiment of the present invention, and with further reference to FIG. 1, the process further comprises:

(i) removing a nitrogen-enriched liquid side stream [32] from an upper location of the high pressure column, reducing the pressure of at least a first portion of it [across valve V4] and feeding said portion to an upper location of the low pressure column;

(ii) removing a second part [29] of the condensed second and third portions of the nitrogen-enriched overhead from the top of the high pressure column as a high pressure liquid nitrogen product; and (iii) removing a second part [48] of the condensed second portion of the nitrogen rich overhead from the top of the low pressure column as a low pressure liquid nitrogen product.

Also in one embodiment of the present invention and with further reference to FIG. 1, the third reboiler/condenser in step (d) is located at the top of the low pressure column The skilled practitioner will appreciate that the following ordinary features of an air separation process, which have been omitted from FIG. 1 for simplicity, can easily be incorporated by one skilled in the art.

(1) Main air compressor, front end clean-up system and main heat exchanger.

Prior to feeding the air feed [10] to the distillation column system, the air feed is compressed in a main air compressor, cleaned of impurities which will freeze out at cryogenic temperatures (such as water and carbon dioxide) and/or other undesirable impurities (such as carbon monoxide and hydrogen) in a front end clean-up 5 stem and cooled to a temperature near its dew point in a main heat exchanger against warming product streams.

(2) Refrigeration generating expander scheme.

Especially where a large quantity of liquid product is desired, it may be necessary to generate additional refrigeration in the process to complete the heat balance. This is typically accomplished by expanding at least a portion of the air feed [10] and/or waste streams [54, 60] and/or nitrogen product streams [22, 42]. Where air expansion is employed, the expanded air is subsequently fed to an appropriate location in the distillation column system, while in the other cases, the expanded gas is subsequently warmed in the main heat exchanger against the incoming air feed. Opportunities may also exist to link the expander with a compressor in the process such that the work produced by the expander is used to drive the compressor (i.e. a compander arrangement). In a preferred embodiment of FIG. 1, the first waste stream [54] is expanded to provide refrigeration to the process.

(3) Subcooling heat exchangers.

Prior to reducing the pressure of the liquid streams 30, 32 and 56 front the high pressure column and feeding them to either the low pressure column [streams 30 and 32] or the reboiler/condenser at the top of the low pressure column [stream 6], such streams may be subcooled in one or more subcooling heat exchangers against warming product streams from the low pressure column [stream 42] and the reboiler/condenser at the top of the low pressure column [stream 60]. This type of heat integration increases the overall thermodynamic efficiency of the process.

(4) Product compressors.

In cases where produced product is required at a higher pressure, product compressors may be deployed. For example, after warming the low pressure nitrogen product stream 42 in the subcooler(s) and main heat exchanger, a product compressor could be utilized to increase the pressure of this stream.

Figure 2:
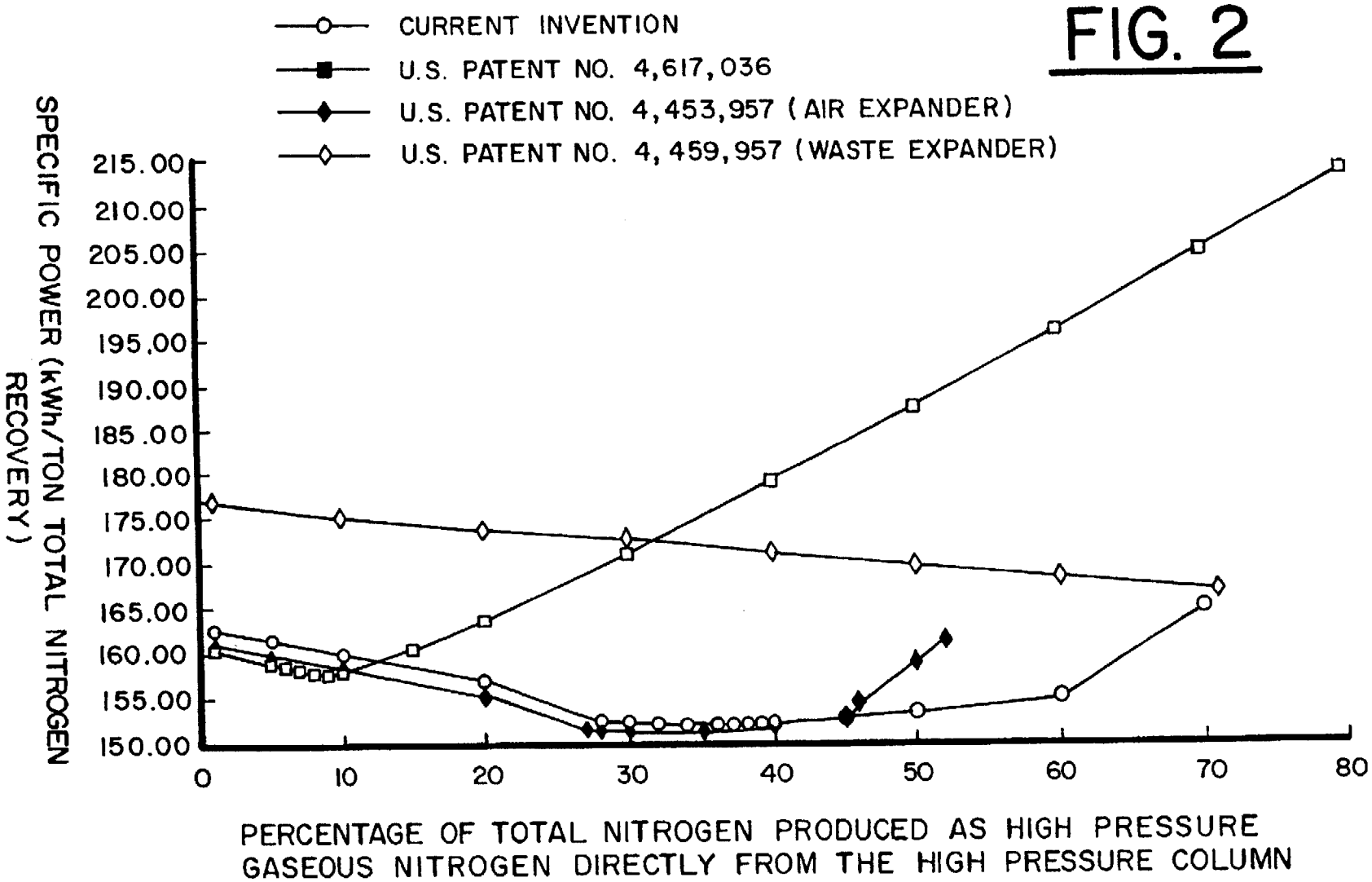
FIG. 2 is a graph which shows the results of a comparison of the present invention with the prior art discussed herein.

FIG. 2 shows the results of a comparison of the present invention with the three prior art processes discussed herein, namely U.S. Pat. No. 4,617,036 and the air expander and waste expander embodiments of U.S. Pat. No. 4,453,957. The particular embodiment of the present invention compared also included waste expansion wherein waste stream [54] in FIG. 1 is expanded in an expander and subsequently warmed against incoming air in the main heat exchanger. Computer simulations were performed that minimized the total specific power while at the same time recovering various percentages of the total nitrogen produced as high pressure gaseous nitrogen directly from the high pressure column. Specific power was calculated as the total power required to deliver all gaseous nitrogen products at 129.7 psia divided by total nitrogen production. The following conclusions can be drawn from FIG. 2:

(1) Since a portion of the air feed stream is sent to the expander to provide refrigeration in the air expander embodiment of U.S. Pat. No. 4,453,957, less a is sent to the high pressure column, and hence less recovery of high pressure gaseous nitrogen is possible. Therefore, the highest possible percentage of total nitrogen recovered as high pressure gaseous nitrogen is 52%.

(2) In the present invention's embodiment, all the air that enters t he plant is sent to the high pressure column. Thus, a higher percentage of high pressure gaseous nitrogen can be recovered from the high pressure column in this cycle than i the air expander embodiment of U.S. Pat. No. 4,453,957. The present invention's embodiment can produce percentages of total nitrogen recovered as high pressure gases nitrogen in the range 53–70% where the air expander embodiment of U.S. Pat. No. 4,453,957 cannot operate.

(3) Although the waste expander embodiment of U.S. Pat. No. 4,453,957 can produce percentages of total nitrogen recovered as high pressure gaseous nitrogen in the range 53–70%, the present invention's embodiment has the lower power requirements of all four cycles in this range.

(4) If the percentage of total nitrogen recovered as high pressure gaseous nitrogen is desired to be 10% or less, it is best to use either the present invention's embodiment or the air expander embodiment of U.S. Pat. No. 4,453,957 and produce 35% of the total nitrogen as high pressure gaseous nitrogen since the power savings is so great.

We claim:

1. A process for the cryogenic distillation of an air feed using a distillation column system comprising a high pressure column, a low pressure column and three reboiler/condensers, said process comprising:

(a) feeding at least a first portion of the air feed to the bottom of the high pressure column;

(b) collecting a nitrogen-enriched overhead at the top of the high pressure column, removing a first portion as a high pressure gaseous nitrogen product, condensing a second portion in a first reboiler/condenser located in the bottom of the low pressure column, condensing a third portion in a second reboiler/condenser and feeding at least a first part of the condensed second and/or third portions as reflux to an upper location in the high pressure column;

(c) removing a crude liquid oxygen stream from the bottom of the high pressure column, reducing the pressure of at least a first portion of it and feeding said first portion to the low pressure column;

(d) collecting a nitrogen rich overhead at the top of the low pressure column, removing a first portion as a low pressure nitrogen product, condensing a second portion in a third reboiler/condenser and feeding at least a first part of the condensed second portion as reflux to an upper location in the low pressure column; and (e) collecting an oxygen rich liquid at the bottom of the low pressure column, vaporizing a first portion in the first reboiler/condenser located in the bottom of the low pressure column, reducing the pressure of a second portion, partially vaporizing said second portion in said second reboiler condenser, removing the resulting vaporized portion as a first waste stream, further reducing the pressure of the remaining liquid portion, vaporizing the liquid portion in the third reboiler/condenser and removing the vaporized stream as a second waste stream.

2. The process of claim 1 which further comprises removing a nitrogen-enriched liquid side stream from an upper location of the high pressure column, reducing the pressure of at least a first portion of it and feeding said portion to an upper location of the low pressure column.

3. The process of claim 2 which further comprises removing a second part of the condensed second and third portions of the nitrogen-enriched overhead from the top of the high pressure column as a high pressure liquid nitrogen product.

4. The process of claim 3 which further comprises removing a second part of the condensed second portion of the nitrogen rich overhead from the top of the low pressure column as a low pressure liquid nitrogen product.

5. The process of claim 1 wherein the third reboiler/condenser in step (d) is located at the top of the low pressure column.

* * * * *